US010052881B2

(12) United States Patent
Wan et al.

(10) Patent No.: US 10,052,881 B2
(45) Date of Patent: Aug. 21, 2018

(54) PRINTER FLUID PRIMING USING MULTIPLE AIR PRIMING UNITS

(71) Applicant: Hewlett-Packard Development Company, L.P., Houston, TX (US)

(72) Inventors: Sing-Yan Wan, Singapore (SG); Michelle Mae Marinito, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/523,342

(22) PCT Filed: Nov. 12, 2014

(86) PCT No.: PCT/US2014/065181

§ 371 (c)(1),
(2) Date: Apr. 28, 2017

(87) PCT Pub. No.: WO2016/076848

PCT Pub. Date: May 19, 2016

(65) Prior Publication Data

US 2017/0246880 A1 Aug. 31, 2017

(51) Int. Cl.

| | |
|---|---|
| ***B41J 2/165*** | (2006.01) |
| ***B41J 2/19*** | (2006.01) |
| ***B41J 2/175*** | (2006.01) |

(52) U.S. Cl.

CPC ..... *B41J 2/19* (2013.01); *B41J 2/16552* (2013.01); *B41J 2/17596* (2013.01); *B41J 2002/16594* (2013.01); *B41J 2002/16597* (2013.01)

(58) Field of Classification Search

CPC ..... B41J 2/175; B41J 2/16526; B41J 2/1707; B41J 2/165; B41J 2/16582; B41J 2002/16555; B41J 2002/16552; B41J 2/16505; B41J 2/16508; B41J 2/16511

See application file for complete search history.

(56) References Cited

U.S. PATENT DOCUMENTS

| | | | |
|---|---|---|---|
| 4,870,431 | A | 9/1989 | Sousa et al. |
| 5,540,569 | A | 7/1996 | Altham et al. |
| 6,419,343 | B1 | 7/2002 | Taylor et al. |
| 6,491,368 | B1 | 12/2002 | Cipolla et al. |
| 7,328,983 | B2 | 2/2008 | Kaga |
| 7,334,883 | B2 | 2/2008 | Campillo et al. |
| 7,415,224 | B2 * | 8/2008 | Hayakawa ..... G03G 21/186 399/111 |

(Continued)

FOREIGN PATENT DOCUMENTS

| | | |
|---|---|---|
| CN | 1766764 | 5/2006 |
| CN | 1771133 | 5/2006 |

(Continued)

*Primary Examiner* — Huan Tran

(74) *Attorney, Agent, or Firm* — HP Inc. Patent Department

(57) ABSTRACT

An air priming system is described that can prime printer fluid of one or more printer fluid tanks of a printer. The air priming system includes multiple priming units that are coupled together so as to be rotated or otherwise adjusted together to be paced into one of a plurality of priming stages. In each of the plurality of priming stages, air flow is either allowed or blocked through specific priming units.

15 Claims, 6 Drawing Sheets

(56) References Cited

U.S. PATENT DOCUMENTS

| | | | | |
|---|---|---|---|---|
| 7,677,710 | B2 * | 3/2010 | Kobayashi | B41J 2/175 347/85 |
| 7,753,473 | B2 | 7/2010 | Nakashima | |
| 7,887,167 | B2 | 2/2011 | Comas et al. | |
| 8,007,070 | B2 | 8/2011 | Kaga et al. | |
| 8,668,319 | B2 | 3/2014 | Gonzales et al. | |
| 2006/0207678 | A1 | 9/2006 | Iwasaki | |
| 2012/0169814 | A1 | 7/2012 | Bryant et al. | |
| 2013/0057605 | A1 | 3/2013 | Miwa | |
| 2014/0111569 | A1 | 4/2014 | Miwa | |

FOREIGN PATENT DOCUMENTS

| | | |
|---|---|---|
| CN | 101052528 | 10/2007 |
| CN | 100511032 | 7/2009 |
| CN | 102092195 | 6/2011 |
| CN | 103213400 | 7/2013 |
| EP | 1029681 | 8/2000 |
| JP | 2013173343 | 9/2015 |

* cited by examiner

PRINTER FLUID PRIMING USING MULTIPLE AIR PRIMING UNITS

BACKGROUND

Inkjet printers can be used to print text, pictures, or other graphics by propelling droplets of liquid printing fluid onto a piece of printer paper or other media. Such printers will often include printer cartridges that house multiple printing fluid reservoirs that feed to corresponding cartridge printheads. The reservoirs will often contain different color printing fluids so as to allow the printer to print color graphics. For example, a printer cartridge can include a first reservoir that contains cyan printing fluid, a second reservoir that contains magenta printing fluid, a third reservoir that contains yellow printing fluid, and a fourth reservoir that contains black printing fluid.

The various reservoirs of such a printer cartridge can be pressurized via a priming process through the use of pressurized air provided from an air pump or other pressure source. Printers that can prime, de-prime, and purge air bubbles from the printhead can offer a user distinct advantages. For example, air bubbles trapped in printheads can cause undesired print artifacts. Actively and rapidly removing air bubbles from the printhead by priming the printhead can allow a user to rectify print problems without replacing the printhead.

BRIEF DESCRIPTION OF THE DRAWINGS

For a detailed description of various examples, reference will now be made to the accompanying drawings in which.

NOTATION AND NOMENCLATURE

In the following discussion and in the claims, the terms "including" and "comprising" are used in an open-ended fashion, and thus should be interpreted to mean "including, but not limited to . . . " The term "approximately" as used herein to modify a value is intended to be determined based on the understanding of one of ordinary skill in the art, and can, for example, mean plus or minus 10% of that value.

DETAILED DESCRIPTION

The following discussion is directed to various examples of the disclosure. Although one or more of these examples may be preferred, the examples disclosed should not be interpreted, or otherwise used, as limiting the scope of the disclosure, including the claims. In addition, the following description has broad application, and the discussion of any example is meant only to be descriptive of that example, and not intended to intimate that the scope of the disclosure, including the claims, is limited to that example.

Figure 1:
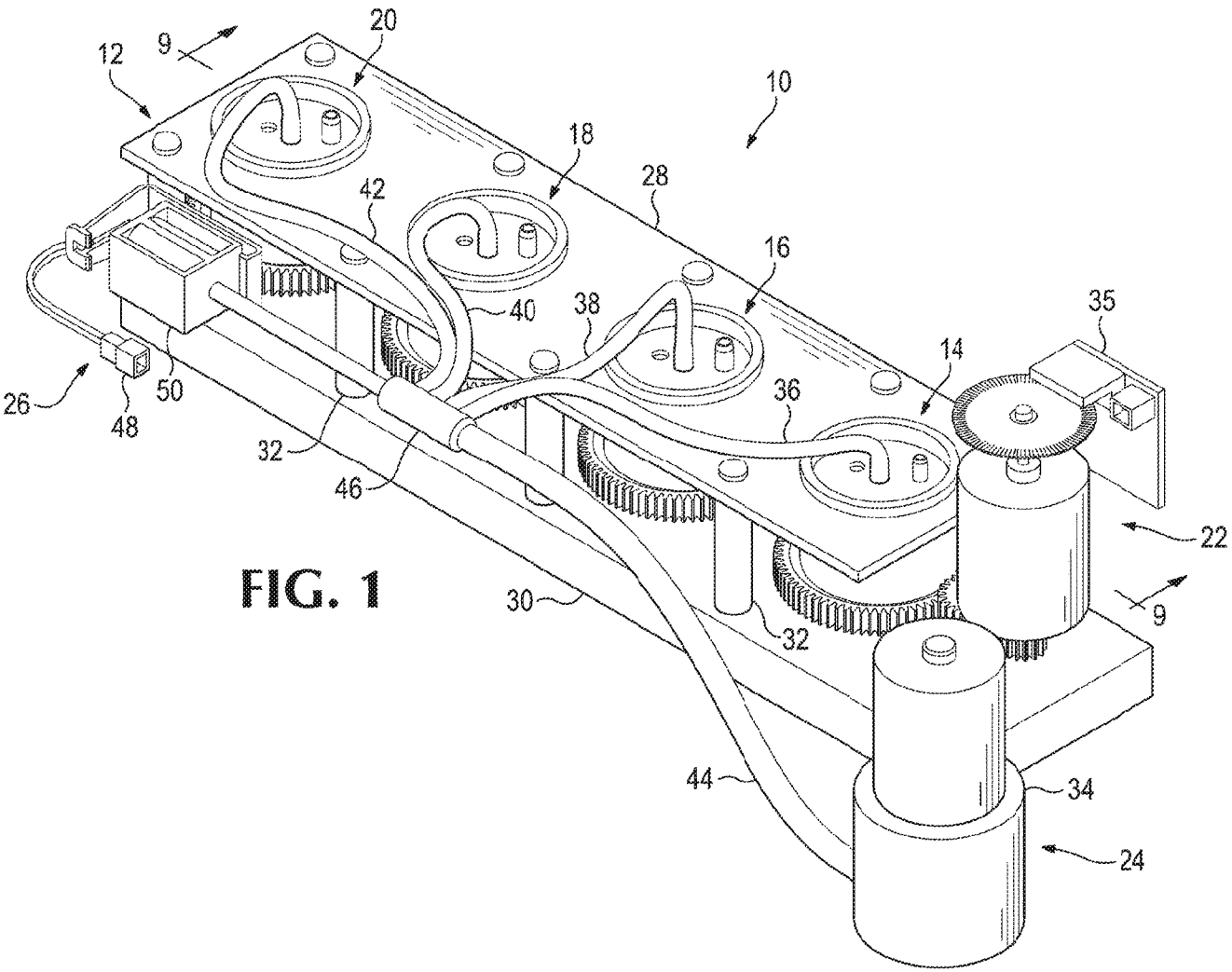
FIG. 1 is a front perspective view of an air priming system for a printer, according to an example.

FIG. 1 illustrates a front perspective view of an air priming system 10 for use in selectively priming printer fluid tanks of a printer. As described in further detail below, system 10 includes a chassis 12, first, second, third, and fourth priming units 14, 16, 18, and 20 to allow selective priming of four respective tanks of printer fluid, a motor unit 22, an air pump unit 24, an air vent unit 26, various intermediary gears (described below), and various air lines (described below). As described in further detail below, air priming system 10 can, for example, be used to allow printer fluid tanks within a printer to be primed individually, which can, for example, prevent undesired printer fluid loss.

Figure 11:
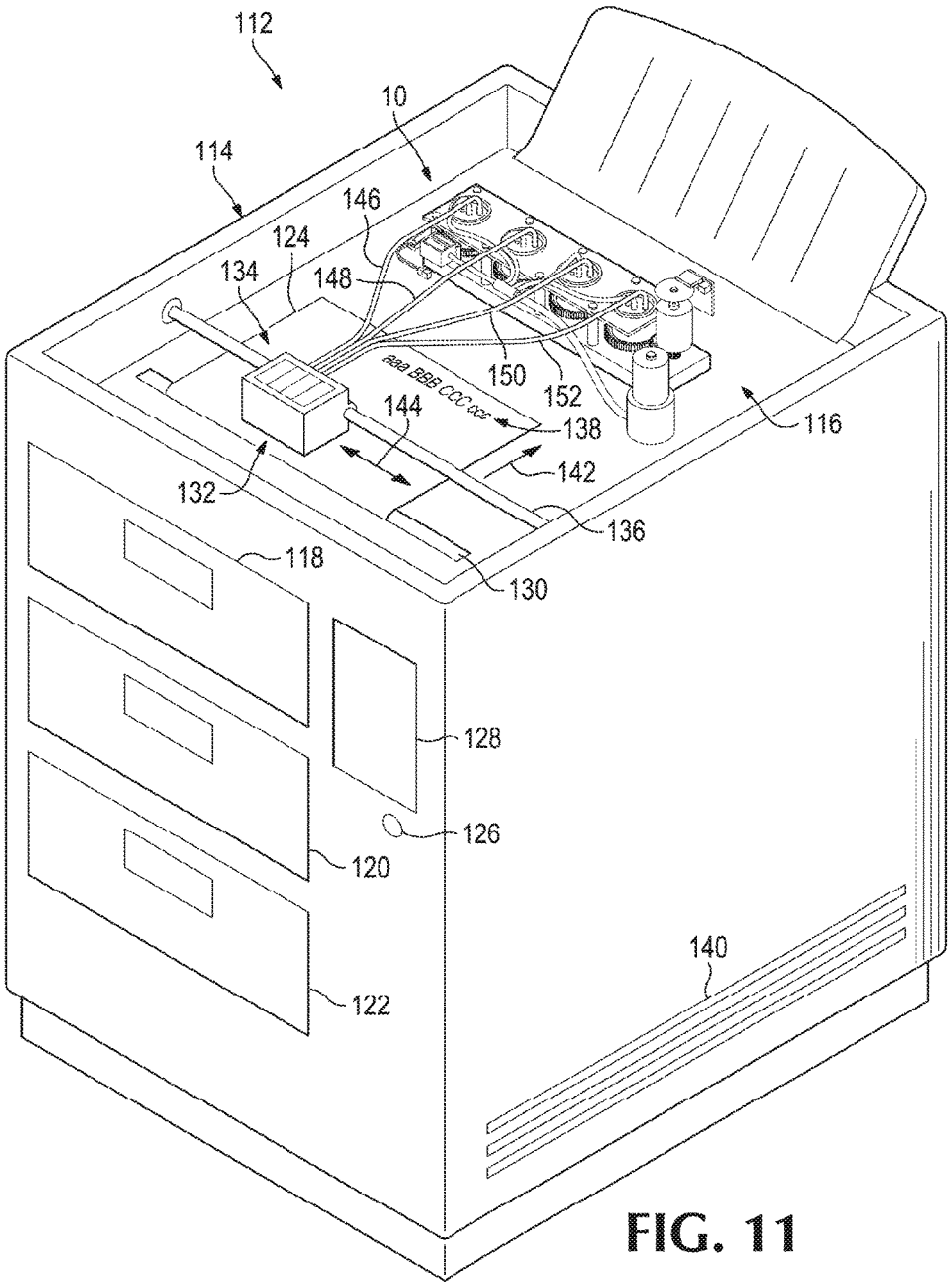
FIG. 11 is a front perspective view of a printer incorporating the air priming system of FIG. 1, according to an example.

The term "printer" as used herein can, for example, refer to both standalone printers as well as other machines capability of printing. For example, the term "printer" as used herein can refer to an all-in-one device that provides printing as well as non-printing functionality, such as a combination printer, scanner, and fax machine. One implementation of a suitable printer for use with the system described herein is shown in FIG. 11 and is described in further detail below. As further described below, the term "printer fluid" can, for example, refer to printer ink as well as suitable non-ink fluids, such as certain gloss enhancers, as well as certain pre- and post-treatments.

As described in further detail below, each priming unit is mechanically coupled to its adjacent priming unit(s) so as to allow a single motive force, such as a rotational force provided by motor unit 22, to adjust each priming unit into either a priming or blocking stage. For example, in some implementations (such as the implementation depicted in FIG. 1), air priming system 10 is adjustable between first, second, third, and fourth priming stages which allow one or more printer fluid tanks to be primed while preventing other printer fluid tanks from being primed. In this implementation, in the first priming stage, air flow is allowed through first priming unit 14 to prime a respective first tank while blocking air flow through the other priming units to prevent priming of the other tanks. In the second priming stage, air flow is allowed through second priming unit 16 to prime a respective second tank while blocking air flow through the other priming units to prevent priming of the other tanks. In the third priming stage, air flow is allowed through third priming unit 18 to prime a respective third tank while blocking air flow through the other priming units to prevent priming of the other tanks. In the fourth priming stage, air flow is allowed through fourth priming unit 20 to prime a respective fourth tank while blocking air flow through the other priming units to prevent priming of the other tanks.

Various implementations of system 10 described herein refer to a printer designed to accommodate four separate printing fluid circuits. The four separate printing fluid circuits can, for example, correspond to circuits for four different colors or types of printing fluid. For example, a first printing fluid circuit can circulate yellow printing fluid, a second printing fluid circuit can circulate cyan printing fluid, a third printing fluid circuit can circulate magenta printing fluid, and a fourth printing fluid circuit can circulate black printing fluid. However, it is appreciated that the same type and color of printing fluid can be provided in separate circuits for redundancy, additional capacity, or other purposes. As but one example, it is anticipated that each circuit can include the same type of black printing fluid. Moreover, it is appreciated that the principles described herein can be applied to printers designed to accommodate fewer than or greater than four printing fluid circuits. For example, in some implementations, air priming system 10 can be used in a printer designed to accommodate only two printing fluid circuits. For example, a first printing fluid circuit can be used to prime a printer fluid tank containing only black printer ink and a second printing fluid circuit can be used to universally prime a multi-color printer fluid tank subdivided into a cyan printer ink tank, a magenta printer ink tank, and a yellow printer ink tank. In such an implementation, air priming system 10 can be adjustable between a first and second priming stage, which can allow one of the printer fluid circuits to be primed while preventing the other printer fluid circuit from being primed.

Figure 9:
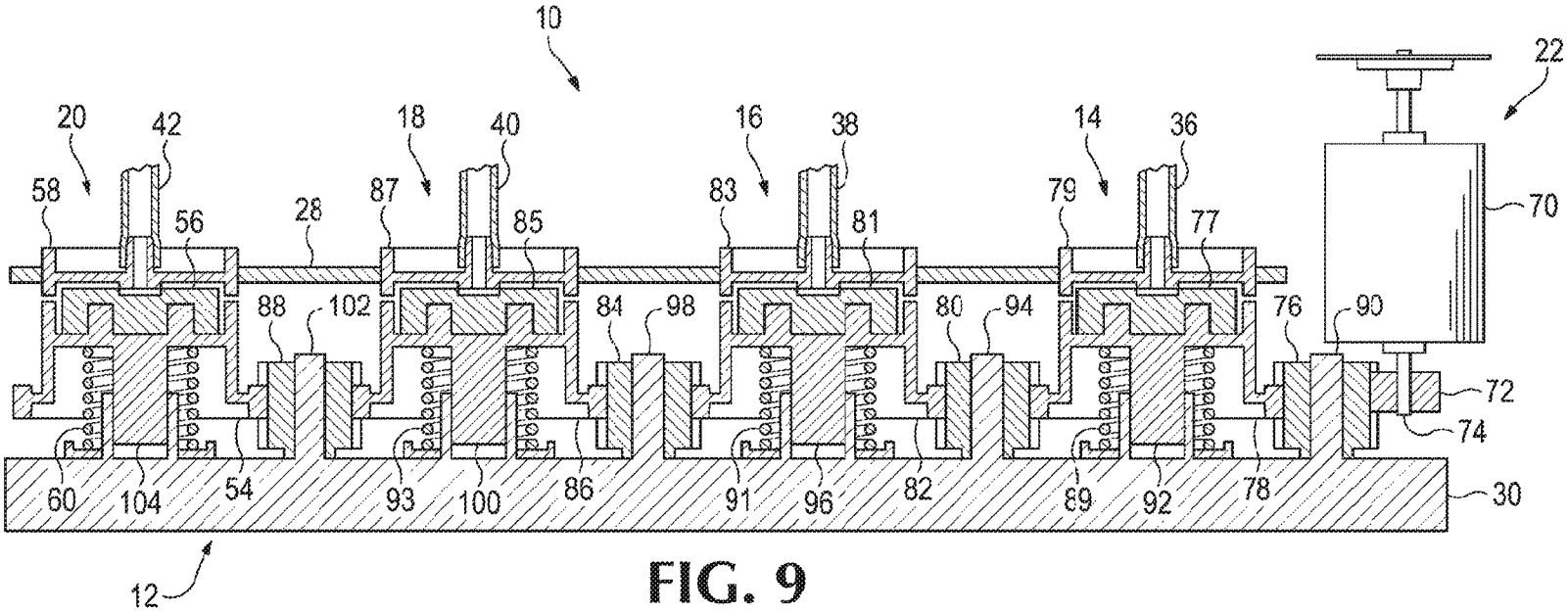
FIG. 9 is a cross-sectional view of the air priming system of FIG. 1 along line 9-9, according to an example.

Chassis 12 of system 10 is used to secure and position one or more components of system 10. For example, in the implementation of system 10 depicted in FIG. 1, chassis 12 secures and positions first, second, third, and fourth priming units 14, 16, 18, and 20, motor unit 22, air vent unit 26, the various intermediary gears of system 10, and the various air lines of system 10. Chassis 12 can, for example, include a top cover 28 supported above a bottom cover 30 via supports 32. In the implementation of FIG. 1, covers 28 and 30 are substantially planar, thin plates, but it is appreciated that other suitable shapes can be used. Top cover 28 includes four circular openings sized to securely receive respective priming units. It is appreciated that the shape of the openings of top cover 28 can, for example, be dictated by the shape of each priming unit and intermediate coupling elements, such as a gasket, can be used to couple the priming unit to chassis 12. As best shown in the cross-sectional view of system 10 that is depicted in FIG. 9, chassis 12 can further include various axles to support respective priming unit gears and intermediate gears and to allow the gears to rotate around the axles.

As described in further detail below with respect to FIGS. 2-8, each priming unit (e.g., first priming unit 14, second priming unit 16, third priming unit 18, and fourth priming unit 20) includes a rotatable component coupled to a priming unit gear so as to rotate along with the priming unit gear. Each priming unit further includes a fixed component that does not rotate with its respective priming unit gear. For example, and as described in further detail below, the rotatable component of a given priming unit can be rotatable between a priming state in which an air channel is opened to allow air pump unit 24 to prime a printer fluid tank connected to the priming unit and a non-priming state in which the air channel is closed to prevent air pump unit 24 from priming the printer fluid tank.

Motor unit 22 is used to provide a force to adjust system 10 between its various priming stages. As described in further detail below, motor unit 22 can, for example, include an encoder 35 to identify a rotational state of motor unit 22 corresponding to each priming stage. For example, a rotational position of motor unit 22 in the first priming stage may be offset from the rotational position of motor unit 22 in the second stage by approximately 90 degrees.

Air pump unit 24 includes an air pump 34 connected to various air lines and related connections to provide priming air to each priming unit. In some implementations, air pump 34 can receive feedback from sensors within system 10 so as to regulate a flow rate of air pump 34 based on the feedback. For example, system 10 can include one or more pressure sensors and air pump 34 can be controlled by a controller that speeds up or slows down air pump 34 based on the feedback from the sensors.

The various air lines can, for example, be in the form of air-tight tubing to serve as a conduit for air. The various air lines of system 10 include priming unit lines 36, 38, 40, and 42 for respective priming units 14, 16, 18, and 20. The lines of the priming units are coupled to an air pump line 44 via an air joint 46 to pass priming air from air pump 34 to respective priming units. For example, first priming unit line 36 is coupled to air joint 46 to pass priming air from air pump 34 to first priming unit 14. The various air lines of system 10 can, for example, further include tank priming lines that couple respective priming units (e.g., 14, 16, 18, and 20) to their respective tanks. For example, a first tank priming line couples first priming unit 14 to a first tank to pass priming air from first priming unit 14 to the first tank. For clarity, the various tank priming lines are not illustrated in FIG. 1, however, one implementation of these lines is illustrated for example in FIG. 11.

Air vent unit 26 can, for example, be used to allow venting of the various air lines of system 10. In some implementations, air vent unit 26 can be coupled to air pump 34 to selectively hold or release air from the air lines connecting air pump 34 to each priming unit. In some implementations, air vent unit 26 can be coupled to air pump 34 through air joint 46. Air vent unit 26 can, for example, include an air vent 48 that can be opened or closed. For example, in some implementations, air vent unit 26 can include a solenoid 50 which can be used to mechanically open or close a path to air vent 48, through which air can be exhausted. Air vent unit 26 can, for example, be designed to remain open until an air priming operation is initiated. In such an implementation, when an air priming operation is initiated, air vent 48 of air vent unit 26 can be closed via solenoid 50 in order to allow pressure to build-up within the various air lines of system 10.

Figure 3:
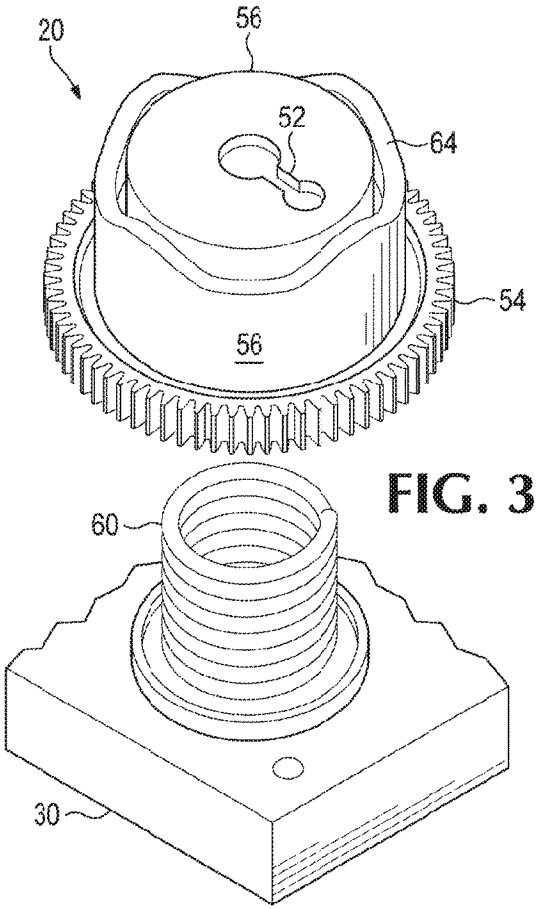
FIG. 3 is a front perspective view of another portion of the air priming unit of the air priming system of FIG. 1, according to an example.
Figure 2:
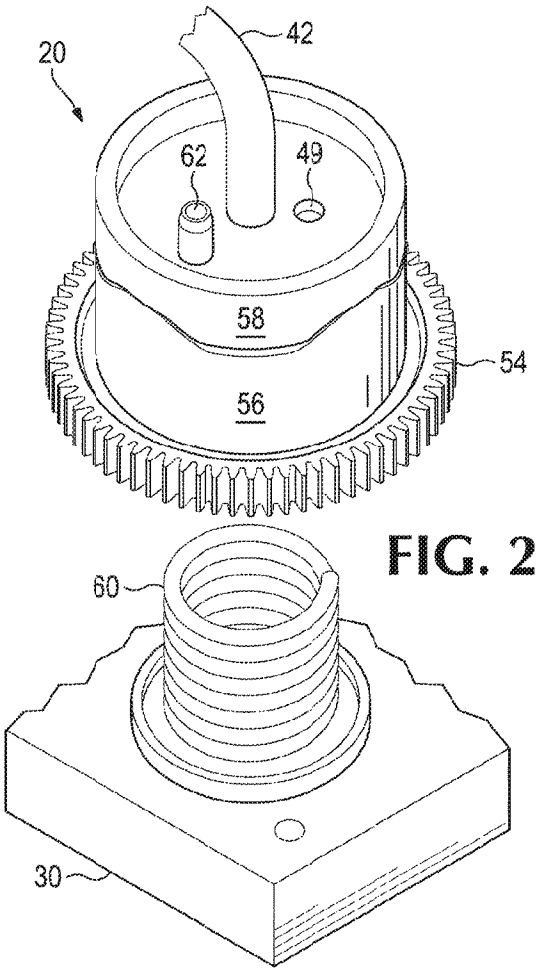
FIG. 2 is a front perspective view of a portion of an air priming unit of the air priming system of FIG. 1, according to an example.

FIGS. 2-8 provide various depictions of fourth priming unit 20. In particular, FIG. 2 illustrates a partially exploded view with priming unit cover installed, FIG. 3 illustrates a view with the cover removed to reveal an air channel 52 for use in priming a printer fluid tank, and FIGS. 4-8 depict a portion of fourth priming unit 20 in various rotational states. Although fourth priming unit 20 is used as an example priming unit, it is appreciated that one or more aspects described herein with respect to fourth priming unit 20 can be applied to one or more other priming units of system 10. For example, in some implementations, system 10 can include four priming units that are identical in structure and function to fourth priming unit 20 of FIG. 2. In some implementations, system 10 can include a first priming unit (e.g., unit 14) that is identical in structure and function to fourth priming unit 20 described herein and three additional priming units that include different structures and/or functions than fourth priming unit 20 described herein.

In the implementation depicted in FIGS. 2-8, priming unit 20 includes a priming unit gear 54, a rotatable body 56 coupled to priming unit gear 54 to rotate along with priming unit gear 54, and a fixed body 58 that does not rotate with priming unit gear 54. Priming unit 20 further includes a spring 60 coupled to rotatable body 56 to bias rotatable body 56 against fixed body 58. In one of the various priming stages, rotatable body 56 is rotated to a position to connect air channel 52 to an air prime outlet 62 of fixed body 58 to allow priming air flow through priming unit 20. In the other priming stages, rotatable body 56 is rotated to a position to block an air flow passage to prevent priming air flow through priming unit 20.

In some implementations, priming unit 20 can include one or more visual or other elements to assist in identification of a desired printer fluid for use with the specific priming unit. Such an element can, for example, be designed to reduce the likelihood of an operator mistakenly connecting in incorrect air line during factor assembly and servicing. For example, in some implementations, priming unit 20 can include a magenta-colored indicator 49 disposed on top of fixed body 58. Such an indicator can signify that the priming unit should be used with magenta-colored printer fluid. In some implementations, indicator 49 can be in the form of an opening in fixed body 58 that exposes a colored surface beneath fixed body 58 that can be used for priming unit identification.

As depicted for example in FIGS. 4-8, spring 60 is coupled to rotatable body 56 to bias rotatable body 56 against fixed body 58. In some implementations, rotatable body 56 and fixed body 58 include corresponding caromed surfaces 64 and 66 that, in combination with spring 60, bias priming unit 20 to rest in a priming stage. For example, cammed surfaces 64 and 66 and spring 60 can function to bias priming unit 20 to rest in either the first, second, third, or fourth priming stage, but not in between priming stages. That is, if rotatable body 56 is temporarily rotated to a position in between priming, spring 60 can force cammed surface 64 of rotatable body 56 against cammed surface 66 of fixed body 58 to force rotatable body 56 into one of the four stable priming positions.

Figure 4:
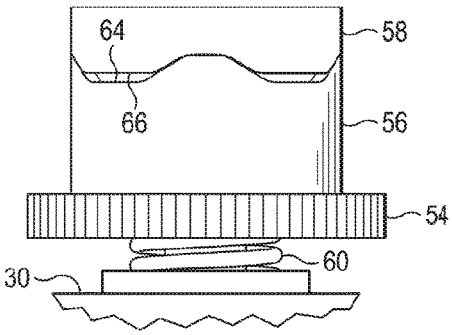
FIG. 4 is a front view of a portion of the air priming unit of FIG. 2 in a first position, according to an example.
Figure 5:
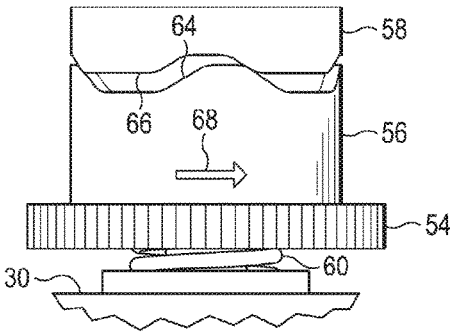
FIG. 5 is a front view of a portion of the air priming unit of FIG. 2 in a second position, according to an example.
Figure 6:
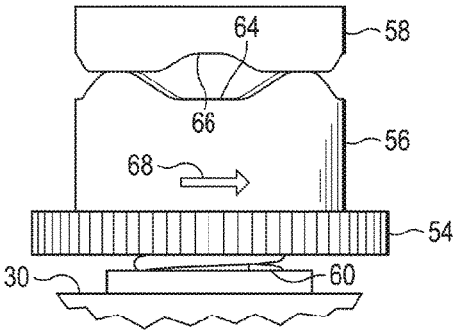
FIG. 6 is a front view of a portion of the air priming unit of FIG. 2 in a third position, according to an example.
Figure 7:
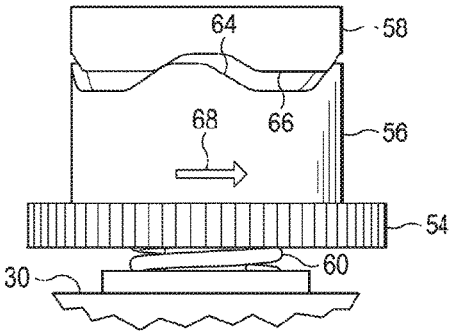
FIG. 7 is a front view of a portion of the air priming unit of FIG. 2 in a fourth position, according to an example.
Figure 8:
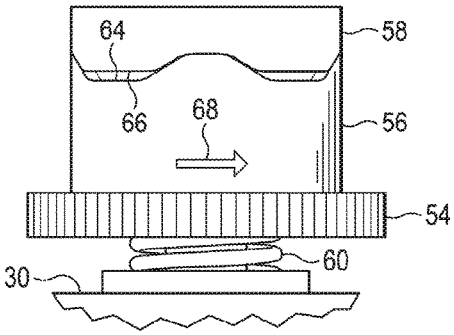
FIG. 8 is a front view of a portion of the air priming unit of FIG. 2 in a fifth position, according to an example.

As an example, rotatable body 56 may begin in a first stable priming position shown in FIG. 4 in which cammed surface 64 mates with cammed surface 66. As rotatable body 56 is rotated in direction 68, rotatable body 56 is moved to the unstable position shown in FIG. 5 in which cammed surface 64 does not mate with cammed surface 66. As rotatable body 56 is further rotated in direction 68, rotatable body 56 is moved to the unstable position shown in FIG. 6 in which cammed surface 64 does not mate with cammed surface 66. As rotatable body 56 is further rotated in direction 68, rotatable body 56 is moved to the unstable position shown in FIG. 7 in which cammed surface 64 does not mate with cammed surface 66. As rotatable body 56 is further rotated in direction 68, rotatable body 56 is moved into a second of the four stable priming positions, with cammed surface 64 again being mated with cammed surface 66.

FIG. 9 is a cross-sectional view of system 10 along line 9-9 of FIG. 1 that illustrates how each priming unit is mechanically coupled to other priming units of system 10 as well as other aspects of system 10. For example, in the implementation depicted in FIG. 10, motor unit 22 includes a motor 70 and a motor gear 72 controlled by motor 70. Motor gear 72 is connected to motor 70 via a shaft 74 extending from motor 70. Motor gear 72 meshes with a first intermediate gear 76, which meshes with a priming unit gear 78 of first priming unit 14. Priming unit gear 78 meshes with a second intermediate gear 80, which meshes with a priming unit gear 82 of second priming unit 16. Priming unit gear 82 meshes with a third intermediate gear 84, which meshes with a priming unit gear 86 of third priming unit 18. Priming unit gear 86 meshes with a fourth intermediate gear 88, which meshes with priming unit gear 54 (described above with respect to FIG. 2) of fourth priming unit 20. As further described above with respect to FIG. 2, in this implementation, each priming unit 14, 16, 18, and 20 includes respective rotatable bodies 77, 81, 85, and 56, respective fixed bodies 79, 83, 87, and 58, and respective springs 89, 91, 93, and 60. The functionality of these rotatable bodies, fixed bodies, and springs are described above with respect to fourth priming unit 20 of FIG. 2. Chassis 12 further includes various axles 90, 92, 94, 96, 98, 100, 102, and 104 to support the various priming unit gears and intermediate gears and to allow the gears to rotate around the axles.

Figure 10:
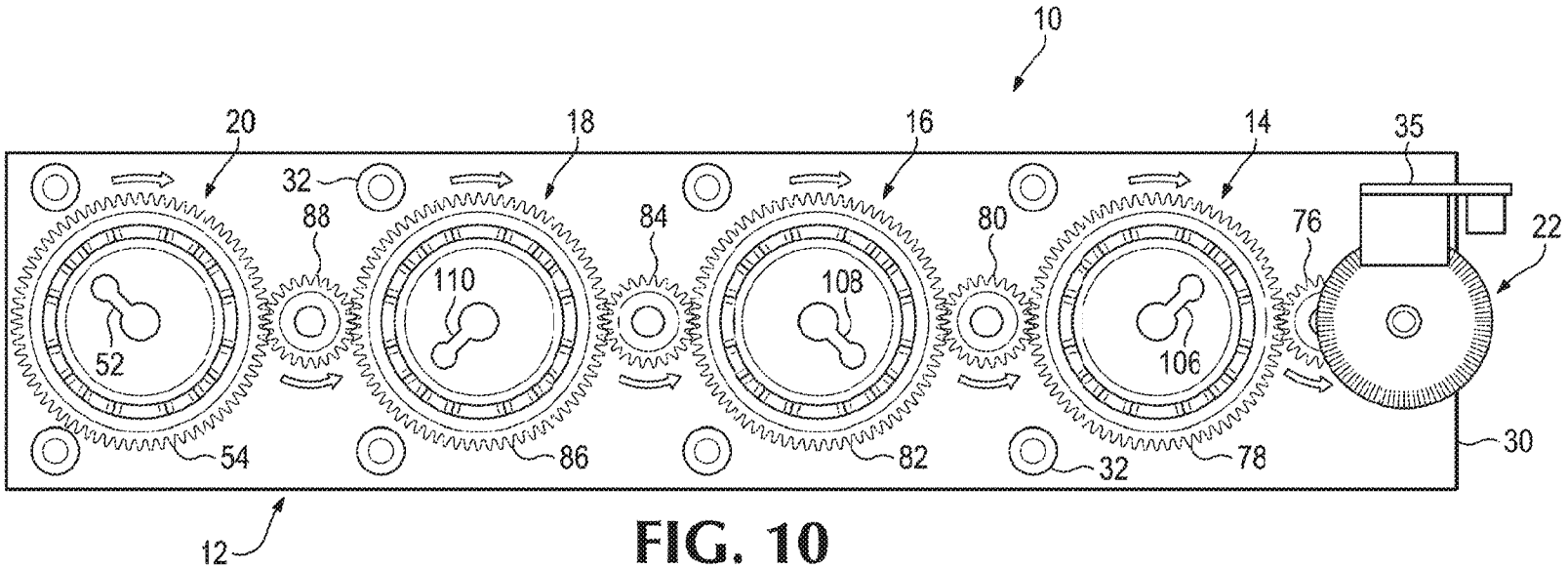
FIG. 10 is a top view of a portion of the air priming system of FIG. 1, according to an example.

FIG. 10 is a top view of system 10 that illustrates that rotational relationship of each priming unit. In particular, when motor gear 72 is rotated a given direction, first, second, third, and fourth priming unit gears 78, 82, 86, and 54 are rotated in the same direction, whereas the intermediate gears 76, 80, 84, and 88 are rotated in an opposite direction. It is appreciated that alternative mechanical couplings can be used. For example, in some implementations first and second priming unit gears 78, 82 (or other adjacent priming unit gears) directly mesh with each other without the use of intermediate gear 80. Each priming unit includes respective air channels 106, 108, 110, and 52 that are coupled with respective air prime outlets (not shown) of each priming unit in order to allow priming air to pass through a given priming unit. Further description of the functionality of air channels is provided above with respect to FIGS. 2-3.

As described above, in some implementations, air priming system 10 can be designed such that it is adjustable between first, second, third, and fourth priming stages which allow one or more printer fluid tanks to be primed while preventing other printer fluid tanks from being primed. For example, in the first priming stage, air flow is allowed through first priming unit 14 to prime a respective first tank while blocking air flow through second, third, and fourth priming units 16, 18, and 20 to prevent priming of the other tanks. In the second priming stage, air flow is allowed through second priming unit 16 to prime a respective second tank while blocking air flow through first, third, and fourth priming units 14, 18, and 20 to prevent priming of the other tanks. In the third priming stage, air flow is allowed through third priming unit 18 to prime a respective third tank while blocking air flow through first, second, and fourth priming units 14, 16, and 20 to prevent priming of the other tanks. In the fourth priming stage, air flow is allowed through fourth priming unit 20 to prime a respective fourth tank while blocking air flow through first, second, and third priming units 14, 16, and 18 to prevent priming of the other tanks. It is appreciated that alternative stages can be used in which multiple priming units allow air flow. As an example, system 10 can be configured such that in a given stage, first, second, and third priming units 14, 16, 18 allow air flow while fourth priming unit 20 blocks air flow. In another example, system 10 can be configured such that in a given stage, all four priming units allow priming air flow. In another example, system 10 can be configured that in a given stage, all four priming units block priming air flow.

FIG. 11 illustrates an implementation of a printer 112 including an air priming system 10 along with other components. For simplicity, air priming system 10 is depicted and referenced as the same system described above with respect to FIGS. 1-10, however it is appreciated that modifications to the system or alternative implementations of an air priming system can be used. As described in further detail below, printer 112 includes a housing 114 that houses various internal parts of printer 112, a printing cavity 116 in which air priming system 10 and other components are located, first, second, and third media trays 118, 120, and 122 for holding a printer media 124 (such as, for example, printer paper), buttons 126 for operating printer 112, and a display screen 128 to display information regarding printer 112. It is appreciated that, in some implementations, printer 112 may include additional, fewer, or alternative components. As but one example, in some implementations, printer 112 may not include buttons 126 or display screen 128 and may instead be remotely controlled by an external computer or controller.

In use, printer media 124 is passed through a slot 130 of printer 112 and is then positioned under a printer cartridge 132. Cartridge 132 includes an array of printer fluid tanks 134 and a printhead for ejecting printer fluid onto printer media 124. The printhead can, for example, be fluidly connected to the printer fluid tanks to receive printer fluid from each tank. Cartridge 132 is designed to move side-to-side along direction 144 relative to printer media 124 along a track 136 installed in printer 112. In some implementations, air priming system 10 can be connected to a printhead on a fixed position print bar with a substrate-wide array of nozzles. In some implementations, printer media 124 can, during printing, be moved under the nozzles of a cartridge printhead connected to air priming system 10. For example, in some printers, the cartridge printhead is moved along a track to position itself at a desired width-wise position of the substrate and the substrate is fed into the printer so as to position itself at a desired length-wise position of the printhead. Air priming system 10 is connected to cartridge 132 via four tank priming lines 146, 148, 150, and 152 connected to respective priming units 14, 16, 18, and 20

Cartridge 132 can be designed to print text, pictures, or other graphics 138 onto media 124 by propelling droplets of liquid printing fluid onto media 124. For example, when the printhead is located at the desired width and length location, the printhead can be instructed to propel one or more droplets of printing fluid onto the substrate in order to print graphic 138 onto the substrate. The printhead and/or the substrate can then be moved to another position and the printhead can be instructed to propel additional droplets of printing fluid onto the substrate in order to continue printing the graphic onto the substrate.

Each printhead within cartridge 132 can be designed to print printing fluid from a nozzle onto printer media 124. Each printhead can, for example, be designed to print via a thermal inkjet process. For example, in certain thermal inkjet processes, printing fluid droplets are ejected from the printhead via a pulse of current that is passed through a heater positioned in the printhead. Heat from the heater causes a rapid vaporization of printing fluid in the printhead to form a bubble, which causes a large pressure increase that propels a droplet of printing fluid onto printer media 124. In some implementations, printheads can be designed to print via a piezoelectric inkjet process. In certain piezoelectric inkjet processes, a voltage is applied to a piezoelectric material located in a printing fluid-filled chamber. When a voltage is applied, the piezoelectric material changes shape, which generates a pressure pulse that forces a droplet of printing fluid from the printhead onto printer media 124.

Housing 114 of printer 112 is designed to house various internal parts of printer 112, such as air priming system 10, a feeder module to feed printer media through printer 112 along feed direction 142, a processor for controlling operation of printer 112, a power supply for printer 112, and other internal components of printer 112. In some implementations, housing 114 can be formed from a single piece of material, such as metal or plastic sheeting. In some implementations, housing 114 can be formed by securing multiple panels or other structures to each other. For example, in some implementations, housing 114 is formed by attaching separate front, rear, top, bottom, and side panels. Housing 114 can include various openings, such as openings to allow media trays 118, 120, and 122 to be inserted into housing 114, as well as vents 140 to allow airflow into the interior of printer 112.

In some implementations, each printer fluid tank within the array of printer fluid tanks 134 can, for example, hold supplies of printer fluid, such as printer ink. Suitable printer fluid can be any suitable type of fluid for use in an inkjet printer. The term "inkjet printer," can, for example, refer to any type of printer that "prints" printer fluid onto printer media 124 using any suitable technique, such as ejecting, spraying, propelling, depositing, or the like. The printheads can be thermal inkjet printhead, piezo electric printhead or the like. The term "printer fluid" can, for example, refer to printer ink as well as suitable non-ink fluids. For example, printer fluid can, for example, include a pre-conditioner, gloss, a curing agent, colored inks, grey ink, black ink, metallic ink, optimizers and the like. Inkjet inks can be water based inks, latex inks or the like. In some implementations, the printer fluid can be in the form of aqueous or solvent printing fluid. Suitable printer fluid can include black, cyan, magenta, yellow, or any other suitable color for using in an inkjet printer.

The various printer fluid tanks can, for example, contain different color printing fluids so as to allow the printer to print color graphics. For example, one printer tank can contain cyan printing fluid, another tank can contain magenta printing fluid, another tank can contain yellow printing fluid, and another tank can contain black printing fluid. The printer fluid tanks can, for example, be in a form suitable for long-term storage, shipment, or other handling. The printer fluid tanks can, for example, be a rigid container with a fixed volume (e.g., a rigid housing), a deformable container (e.g., a deformable bag), or any other suitable container for the printing fluid supply.

Media trays 118, 120, and 122 can be used to store printer media, such as for example printer paper. Each media tray can, for example, be designed to hold the same or a different size media. For example, media tray 118 can be designed to hold standard letter-sized paper, media tray 120 can be designed to hold A4 paper, and media tray 122 can be designed to hold 11×17 paper. It is appreciated that air priming system 10 can be used in printers with only a single media tray or, in some implementations, with no media trays.

Printer 112 can include one or more input devices to send operator inputs to printer 112. For example, as depicted in FIG. 11, such input devices can include buttons 126, which can, for example, be designed to allow an operator to cancel, resume, or scroll through print jobs. Buttons 126 can also be designed to allow an operator to view or modify printer settings. It is appreciated that in some implementations, printer 112 can be remotely controlled by a remote computer or operator and may not include buttons 126 or other user inputs.

Printer 112 can include one or more output devices to provide output information from printer 112 to an operator. For example, as depicted in FIG. 11, such an output device can be in the form of a display screen 128 connected to a processor to display information regarding printer 112, such as information regarding a current or queued print job, information regarding settings of printer 112, or other information. It is appreciated that printer 112 may include other types of output devices to convey information regarding printer 112, such as a speaker or other suitable output device.

In some implementations, display screen 128 and buttons 126 can be combined into a single input/output unit. For example, in some implementations, display screen 128 can be in the form of a single touchscreen that both accepts input and displays output. In some implementations, printer 112 does not include any input/output units and is instead connected to another device or devices for receiving input and sending output. For example, in some implementations, printer 112 can interface with a remote computer over the internet or within an internal network. The remote computer can, for example, receive input from a keyboard or other suitable input device, and output information regarding printer 112 via a monitor or other suitable output device.

Printer media 124 can be in the form of any media onto which printer 112 is designed to print. For example, printer media 124 can be in the form of computer paper, photographic paper, a paper envelope, or similar paper media. Printer media 124 can be a standard rectangular paper size, such as letter, A4 or 11×17. It is appreciated, however, that printer media 124 can in some implementations be in the form of suitable non-rectangular and/or non-paper media, such as clothing, wood, or other suitable materials.

While certain implementations have been shown and described above, various changes in form and details may be made. For example, some features that have been described in relation to one implementation and/or process can be related to other implementations. In other words, processes, features, components, and/or properties described in relation to one implementation can be useful in other implementations. Furthermore, it should be understood that the systems, apparatuses, and methods described herein can include various combinations and/or sub-combinations of the components and/or features of the different implementations described. Thus, features described with reference to one or more implementations can be combined with other implementations described herein.

The choice of materials for the parts described herein can be informed by the requirements of mechanical properties, temperature sensitivity, moldability properties, or any other factor apparent to a person having ordinary skill in the art. For example, one more of the parts (or a portion of one of the parts) can be made from suitable plastics, metals, and/or other suitable materials.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. A system comprising:

a first priming unit to prime a first tank of printer fluid, the first priming unit including a first priming unit gear; and a second priming unit to prime a second tank of printer fluid, the second priming unit including a second priming unit gear that is coupled to the first priming unit gear so as to rotate when the first priming unit gear is rotated;

wherein the system is adjustable between a first priming stage and a second priming stage in which: (1) the first priming stage allows air flow through the first priming unit to prime the first tank while blocking air flow through the second priming unit to prevent priming of the second tank, and (2) the second priming stage blocks air flow through the first priming unit to prevent priming of the first tank while allowing air flow through the second priming unit to prime the second tank.

2. The system of claim 1, further comprising:

a motor unit, the motor unit including a motor and a motor gear controlled by the motor, wherein the motor gear is mechanically coupled to the first priming unit gear via an intermediate gear so as to rotate the first priming unit gear when the motor gear is rotated.

3. The system of claim 1, further comprising:

an air pump to provide priming air to the first priming unit and the second priming unit.

4. The system of claim 3, further comprising:

an air pump line coupled to the air pump to pass air from the air pump;

an air joint coupled to the pump line;

a first priming unit line coupled to the air joint to pass priming air from the air pump to the first priming unit; and a second priming unit line coupled to the air joint to pass priming air from the air pump to the second priming unit.

5. The system of claim 1, further comprising:

a first tank priming line coupling the first priming unit to the first tank to pass priming air from the first priming unit to the first tank; and a second tank priming line coupling the second priming unit to the second tank to pass priming air from the second priming unit to the second tank.

6. The system of claim 1, wherein the first priming unit includes:

a first rotatable body that is coupled to the first priming unit gear to rotate with the first priming unit gear; and a first fixed body that does not rotate with the first priming unit gear;

wherein in the first priming stage, the first rotatable body is rotated to a position to open an air flow passage to allow priming air flow through the first priming unit, and wherein in the second priming stage, the first rotatable body is rotated to a position to block an air flow passage to prevent priming air flow through the first priming unit.

7. The system of claim 6, further comprising:

a spring coupled to the first rotatable body to bias the first rotatable body against the first fixed body, wherein the first rotatable body and the first fixed body include corresponding cammed surfaces that, in combination with the spring, bias the first priming unit to rest in a priming stage.

8. The system of claim 1, wherein each tank is to hold one of black, cyan, magenta, and yellow ink.

9. The system of claim 1, further comprising:

a third priming unit to prime a third tank of printer fluid, the third priming unit including a third priming unit gear that is coupled to the second priming unit gear so as to rotate when the second priming unit gear is rotated; and a fourth priming unit to prime a fourth tank of printer fluid, the fourth priming unit including a fourth priming unit gear that is coupled to the third priming unit gear so as to rotate when the third priming unit gear is rotated;

wherein the system is adjustable between a first priming stage, a second priming stage, a third priming stage, and a fourth priming stage:

(1) the first priming stage allowing air flow through the first priming unit to prime the first tank while blocking air flow through the second, third, and fourth priming units to prevent priming of the second, third, and fourth tanks, (2) the second priming stage allowing air flow through the second priming unit to prime the second tank while blocking air flow through the first, third and fourth priming units to prevent priming of the first, third, and fourth tanks, (3) the third priming stage allowing air flow through the third priming unit to prime the third tank while blocking air flow through the first, second, and fourth priming units to prevent priming of the first, second, and fourth tanks, and (4) the fourth priming stage allowing air flow through the third priming unit to prime the fourth tank while blocking air flow through the first, second, and third priming units to prevent priming of the first, second, and third tanks.

10. A printer comprising:

a first tank of printer fluid;

a second tank of printer fluid;

an air priming system including:

an air pump to provide priming air;

a first priming unit coupled to the air pump and the first tank to allow priming of the first tank, wherein the first priming unit includes a first priming unit gear;

a second priming unit coupled to the air pump and the second tank to allow priming of the second tank, wherein the second priming unit includes a second priming unit gear that is coupled to the first priming unit gear so as to rotate when the first priming unit gear is rotated; and a motor unit including a motor gear that is coupled to the first priming gear to place the air priming system in a first priming stage in which the first tank is primed by flowing air through the first priming unit and the second tank is not primed, and a second priming stage in which the first tank is not primed and the second tank is primed by flowing air through the second priming unit, wherein the priming stage is based on the rotation of the first and second priming gears; and a printhead fluidly connected to the first tank and the second tank to receive printer fluid from the first tank and printer fluid from the second tank.

11. The printer of claim 10, further comprising:

an air vent to selectively hold or release air in an air line connecting the air pump to the first and second priming unit.

12. The printer of claim 10, wherein the motor includes an encoder to allow the motor to select a rotation of the motor gear that corresponds to the first or second priming stage.

13. The printer of claim 10, wherein the rotational position of the motor gear in the first stage is offset from the rotational position of the motor gear in the second stage by approximately 90 degrees.

14. A system comprising:

a first priming unit including a first rotatable component that is rotatable between a priming state in which a first air channel is opened to allow an air pump to prime a first printer fluid tank and a non-priming state in which the first air channel is closed to prevent the air pump from priming the first printer fluid tank; and a second priming unit including a second rotatable component that is rotatable between a priming state in which a second air channel is opened to allow the air pump to prime the second printer fluid tank and a non-priming state in which the second air channel is closed to prevent the air pump from priming the second printer fluid tank, wherein rotation of the first rotatable component is to cause rotation of the second rotatable component such that when the first priming unit is in the priming state, the second priming unit is in the non-priming state and when the first priming unit is in the non-priming state, the second priming unit is in the priming state.

15. The system of claim 14, wherein the first rotatable component includes a first rotatable gear and the second rotatable component includes a second rotatable gear, and wherein the first rotatable gear is coupled to the second rotatable gear via an intermediate gear to cause relative rotation between the first rotatable gear and the second rotatable gear.

* * * * *